United States Patent [19]

White

[11] 4,451,217

[45] May 29, 1984

[54] ROTARY FLUID PRESSURE DEVICE

[76] Inventor: Harvey C. White, 3733 Capilano, West Lafayette, Ind. 47906

[21] Appl. No.: 284,128

[22] Filed: Jul. 16, 1981

Related U.S. Application Data

[63] Continuation-in-part of Ser. No. 29,019, Apr. 12, 1979, Pat. No. 4,285,643, which is a continuation-in-part of Ser. No. 903,589, May 8, 1978, abandoned.

[51] Int. Cl.[3] ..... F04C 15/00

[52] U.S. Cl. ..... 418/69; 418/61 B; 74/405; 192/96

[58] Field of Search ..... 418/39, 69, 61 B; 192/96, 97; 74/405, 805

[56] References Cited

U.S. PATENT DOCUMENTS

| | | | |
|---|---|---|---|
| 2,681,713 | 6/1954 | Chambers | 418/69 X |
| 3,504,564 | 4/1970 | Kell | 74/405 |
| 3,729,276 | 4/1973 | Boyadjieff et al. | 418/69 X |
| 3,807,249 | 4/1974 | Cheek et al. | 74/405 |
| 3,835,722 | 9/1974 | Bertram et al. | 74/405 |
| 3,973,880 | 8/1976 | Swedberg | 418/61 B |
| 4,181,042 | 1/1980 | Ray et al. | 192/97 |

*Primary Examiner*—Leonard E. Smith
*Attorney, Agent, or Firm*—Woodling, Krost & Rust

[57] ABSTRACT

A rotary fluid pressure device is described as comprising a housing having fluid inlet and outlet openings and in the housing is a gerotor device having an external stator having internal teeth and a rotor within the stator having external teeth, one less in number than those on the stator. The rotor is eccentrically mounted with respect to the stator so that upon rotation of the rotor, the sealing engagement between the external and internal teeth forms expanding cells on one side of the line of eccentricity and forms contracting cells on the other side of the line. A drive shaft concentric with the rotor has a hollow end within the housing and a solid drive end outside of the housing. A wobble stick drivingly connects the rotor and the shaft and the wobble stick has a pivot point at its inner end connected by a rigid pivot pin with a central recess in the housing axially of the shaft which eliminates axial movement between the drive shaft and the rotor which would otherwise be caused by an uneven end formed by wear on the wobble stick. The wobble stick is selectably disengagable from drivingly connecting the rotor and the shaft through axial movement of the wobble stick. A manifold, fixed in the housing, provides a double balance pad diametrically opposite each of an inlet passage for conducting inlet fluid to each of the cells between the stator and rotor. Twelve shallow slots are hobbed over six angled holes conducting fluid to the expanding and contracting cells and over six radial holes leading to the balance pads, giving the required accuracy. A novel seal and thrust bearing structure, where the drive shaft exits from the housing, results in good concentricity of the seal carrier and a thrust bearing between the seal carrier and the adjacent end of the housing provides with a flow pumped by the bearing during rotation of the device, which results in a lower temperature on the seal and bearing.

12 Claims, 29 Drawing Figures

ROTARY FLUID PRESSURE DEVICE

This application is a continuation-in-part of U.S. Patent application Ser. No. 29,019, filed Apr. 12, 1979 entitled "Rotary Fluid Pressure Device", now U.S. Pat. No. 4,285,643, such 29,019 application is a continuation-in-part of U.S. Patent application Ser. No. 903,589, filed May 8, 1978 and entitled "Rotary Fluid Pressure Device", now abandoned.

The object of this invention is to provide a gerotor device having a controlled pivot point which locates the drive link or wobble stick relative to the housing and prevents wear by eliminating the possibility of axial movement between the drive shaft and the housing which might be caused by an uneven end position.

Another object of this invention is to provide for a disengagable drive between the drive shaft and the rotor to reduce the wear of the gerotor device and thermal degradation of the hydraulic fluid.

Another object is to provide a gradual balancing by a double balancing pad rather than an abrupt action.

Another object is to provide twelve shallow slots hobbed over six angle holes and six radial holes as part of the flow passageways to and from the changing cells in the gerotor structure, the hobbing providing the required accuracy.

Another object of the invention is to provide a fluid flow loop in the housing, giving a fluid flow through a needle thrust bearing next to a shaft seal, thus increasing the thrust bearing capabilities and the seal and bearing life.

A still further object of the invention is to provide a seal at the exit point of the drive shaft from the housing which includes a generally L-shaped spacer or carrier having one leg against the thrust bearing and the other leg against the shaft thus providing good concentricity of the seal carrier on the shaft.

Other objects and advantages of this invention will be apparent from the accompanying drawings and description and the essential features thereof will be set forth in the appended claims.

Figure 4:
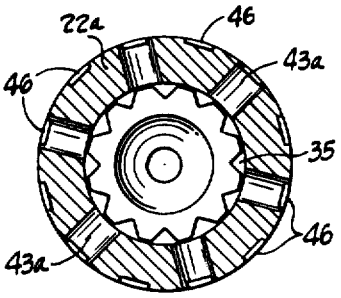
Figure 3:
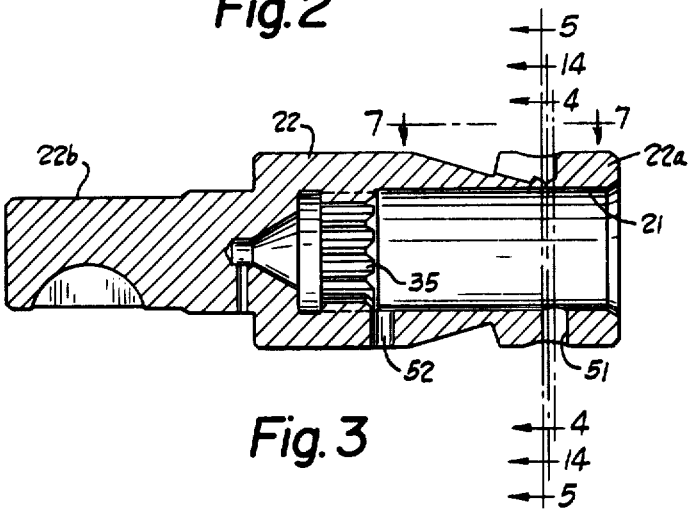
FIG. 3 is a central sectional view of the drive shaft itself turned 180° from position as shown in FIG. 1.
Figure 5:
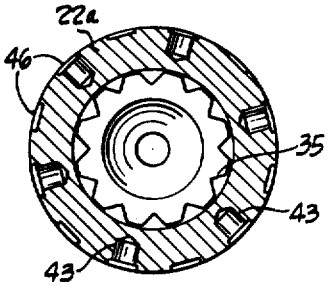

FIGS. 4 and 5 are sectional view taken respectively along the lines 4—4 and 5—5 of FIG. 3.

Figure 6:
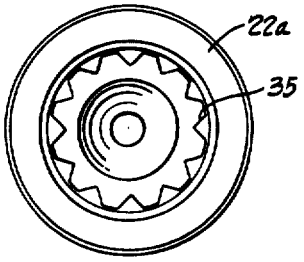

FIG. 6 is an end view of FIG. 3 taken at the right-hand end thereof.

Figure 7:
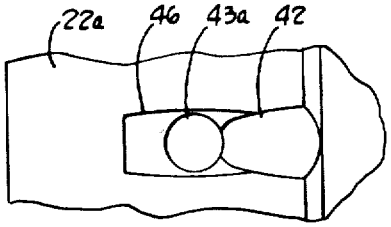

FIG. 7 is a view of one of the hobbed openings taken from the position of the line 7—7 of FIG. 3.

Figure 1:
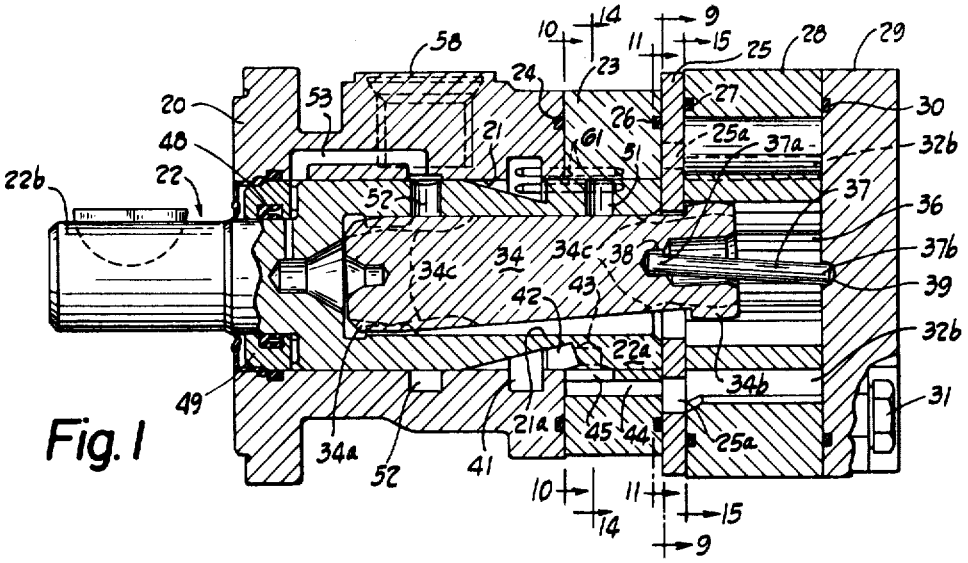
FIG. 1 is a central sectional view of the rotary fluid pressure device taken along the line 1—1 of FIG. 2.
Figure 8:
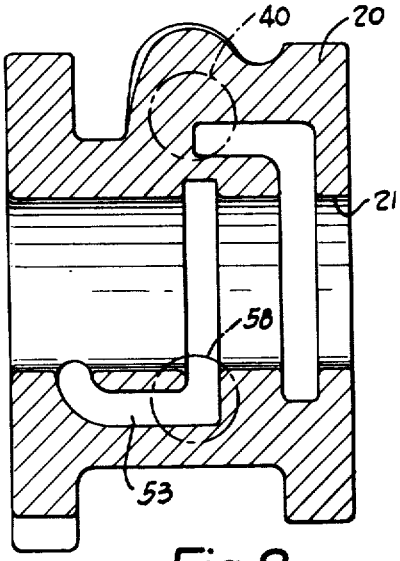

FIG. 8 is a sectional view of the housing of FIG. 1 taken through the bypass shown near the left end of FIG. 1 which connects the thrust bearing with the inlet fluid opening.

Figure 9:
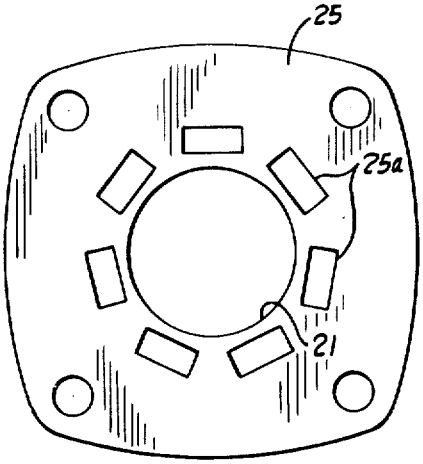

FIG. 9 is a view of the wear plate taken along the line 9—9 of FIG. 1.

Figure 10:
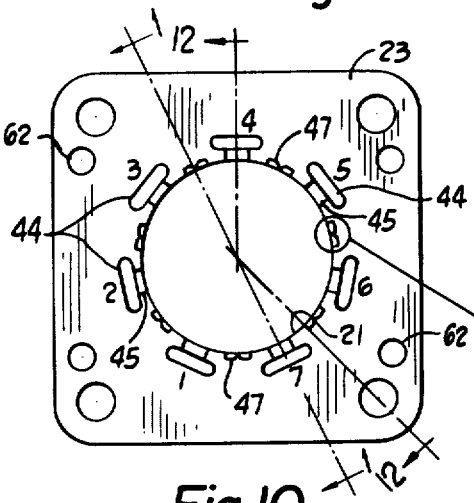

FIG. 10 is a view of the manifold taken on the line 10—10 of FIG. 1.

FIG. **10*a* is an enlarged end view taken in the circle of FIG. 10** and being an end view looking along one of the double balancing pads.

Figure 11:
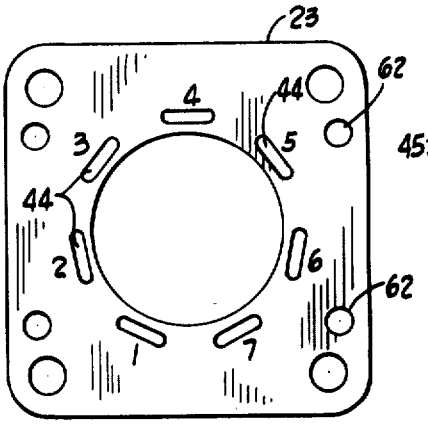

FIG. 11 is a sectional view near the right-hand side of the manifold, taken along the line 11—11 of FIG. 1.

Figure 12:
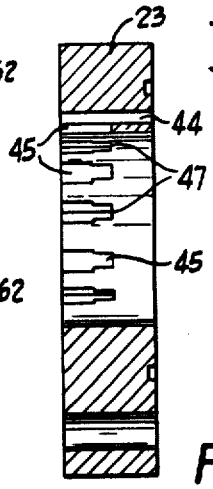

FIG. 12 is a sectional view of the manifold taken along the line 12—12 of FIG. 10.

Figure 13:
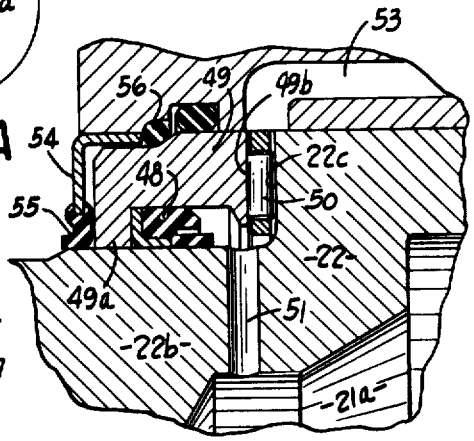

FIG. 13 is an enlarged view of the shaft seal construction shown at the left end of FIG. 1.

Figure 14:
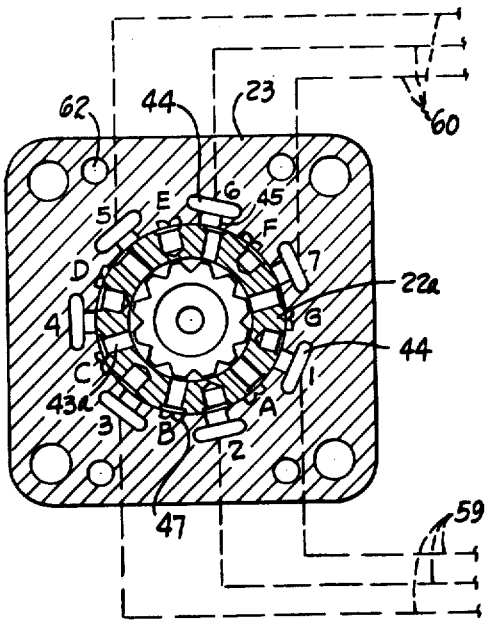

FIG. 14 is a sectional view taken along the line 14—14 of FIG. 1.

Figure 15:
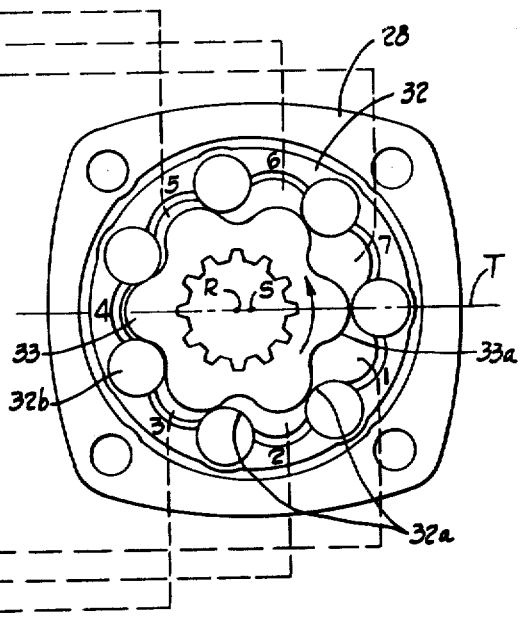

FIG. 15 is a view of the gerotor structure as seen along the line 15—15 of FIG. 1.

Figure 16:
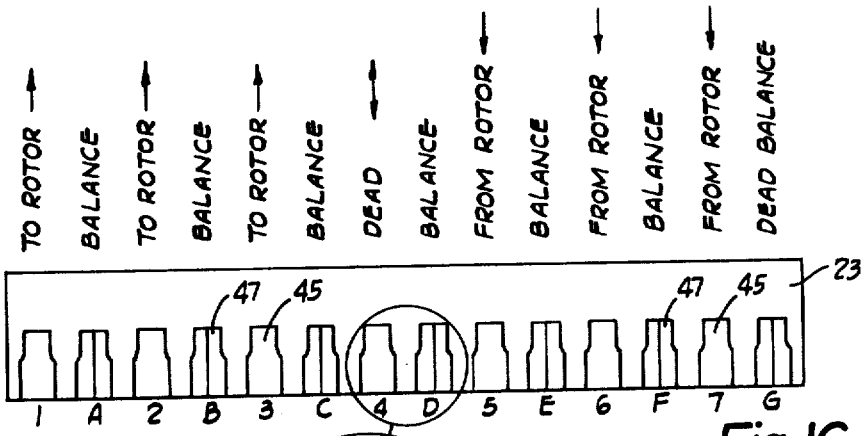

FIG. 16 is a view showing the alternately arranged fluid inlet slots and balance pads of FIG. 12, the same being unrolled and presented in a linear view looking from the inside out.

FIG. **16*a* is an enlarged view taken at the circle shown in FIG. 16 and is really a combination of FIGS. 7 and 16**.

Figure 17:
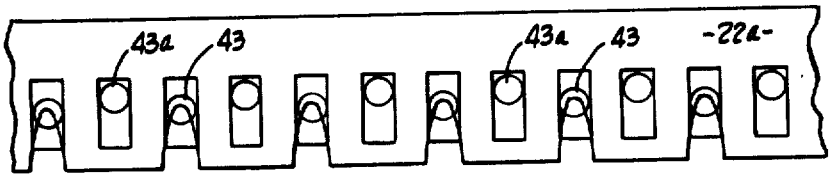

FIG. 17 is a view of the structure toward the right-hand end of the hollow portion of the drive shaft, the same being a view unrolled and presented linearly as from the outside looking in.

Figure 18:
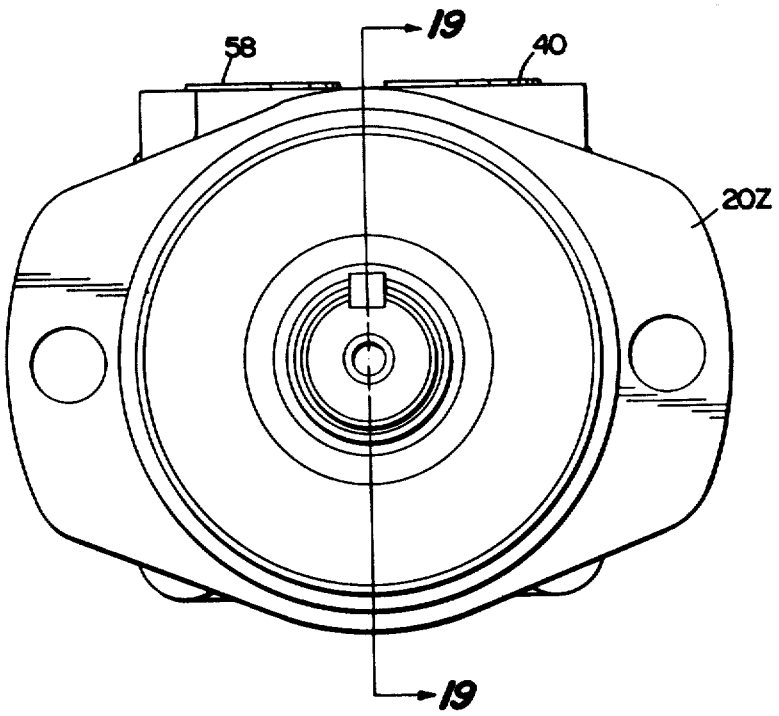

FIG. 18 is a shaft end view of an alternate form of the claimed rotary fluid pressure device of the present invention.

Figure 19:
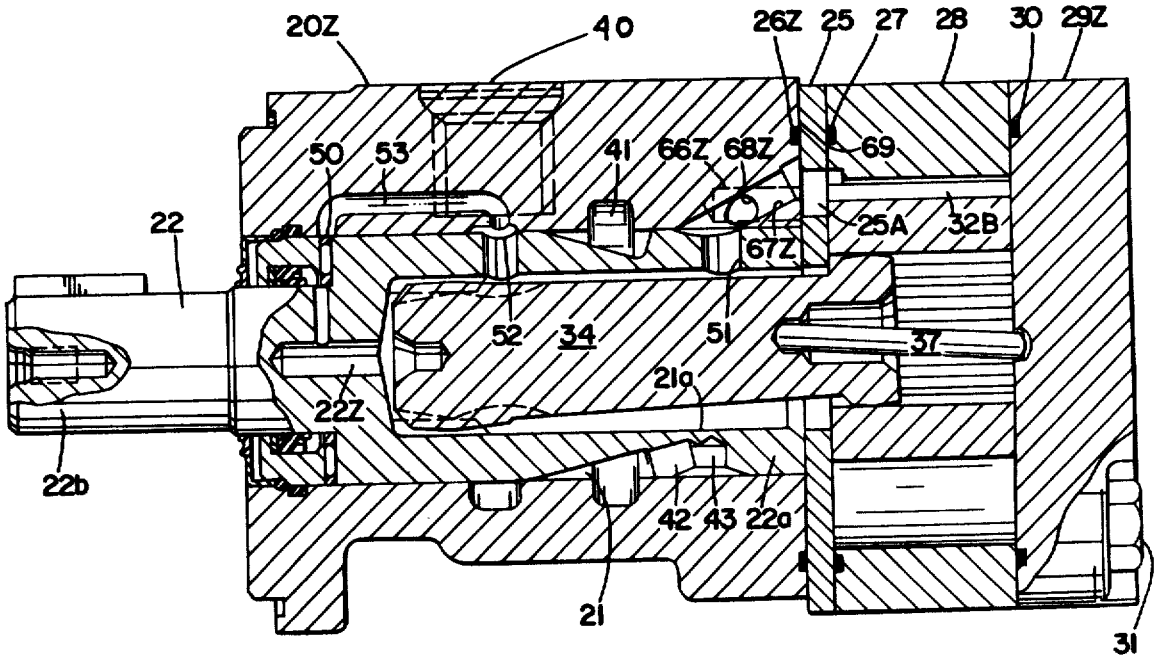

FIG. 19 is a central sectional view of the alternate form taken generally along line 19—19 of FIG. 18.

Figure 20:
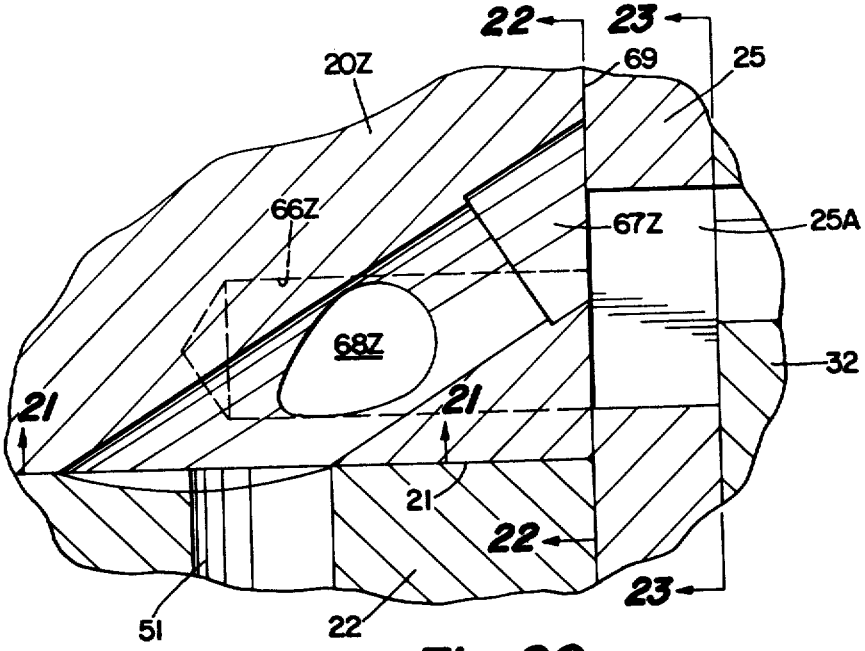

FIG. 20 is an enlarged fragmentary sectional view of the area of a fluid outlet opening shown in FIG. 19.

Figure 21:
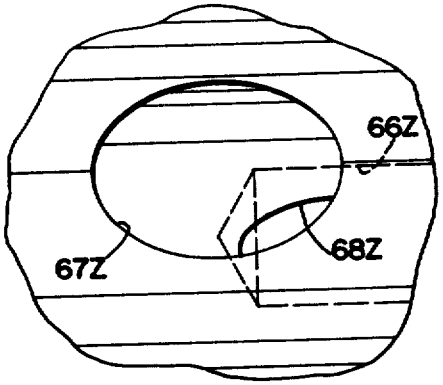

FIG. 21 is an enlarged fragmentary view of a fluid outlet opening taken along line 21—21 of FIG. 20.

Figure 22:
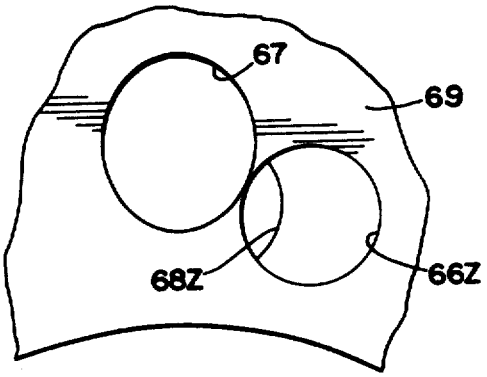

FIG. 22 is an enlarged fragmentary end view of a fluid outlet opening taken along line 22—22 of FIG. 20.

Figure 23:
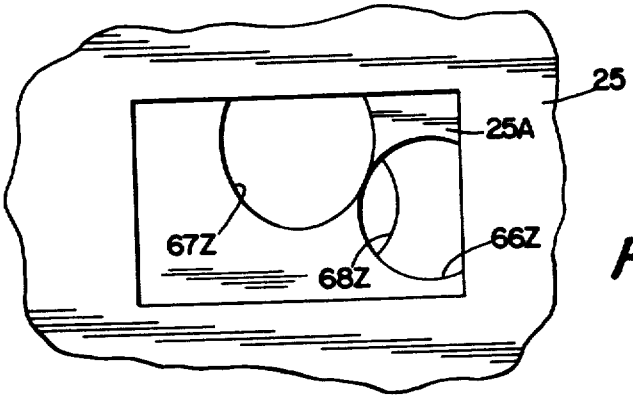

FIG. 23 is an enlarged fragmentary end view of a fluid outlet opening as it appears in combination with a wear plate. The view is taken along the line 23—23 of FIG. 20.

Figure 24:
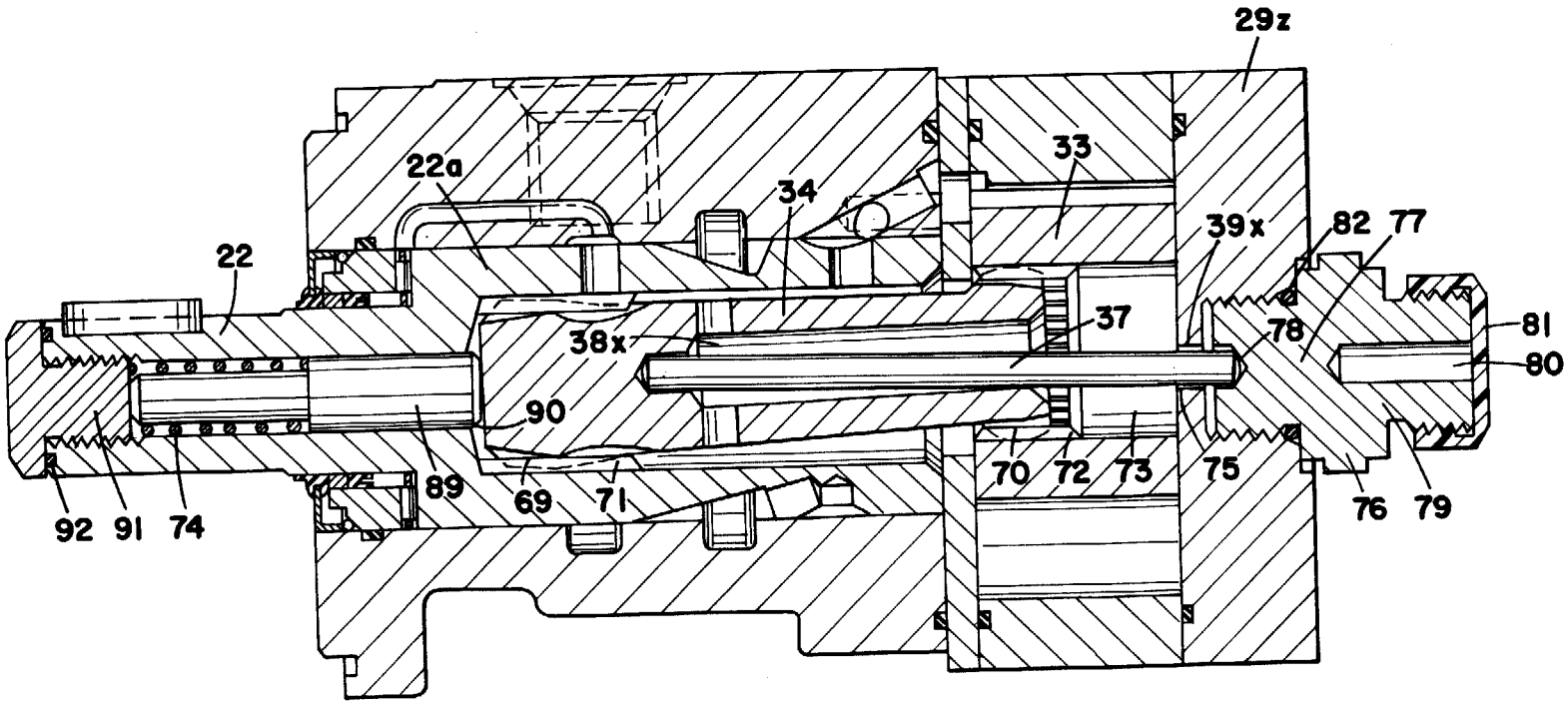

FIG. 24 is a central sectional view of a manually disengagable drive gerotor device with the drive in the engaged position.

Figure 25:
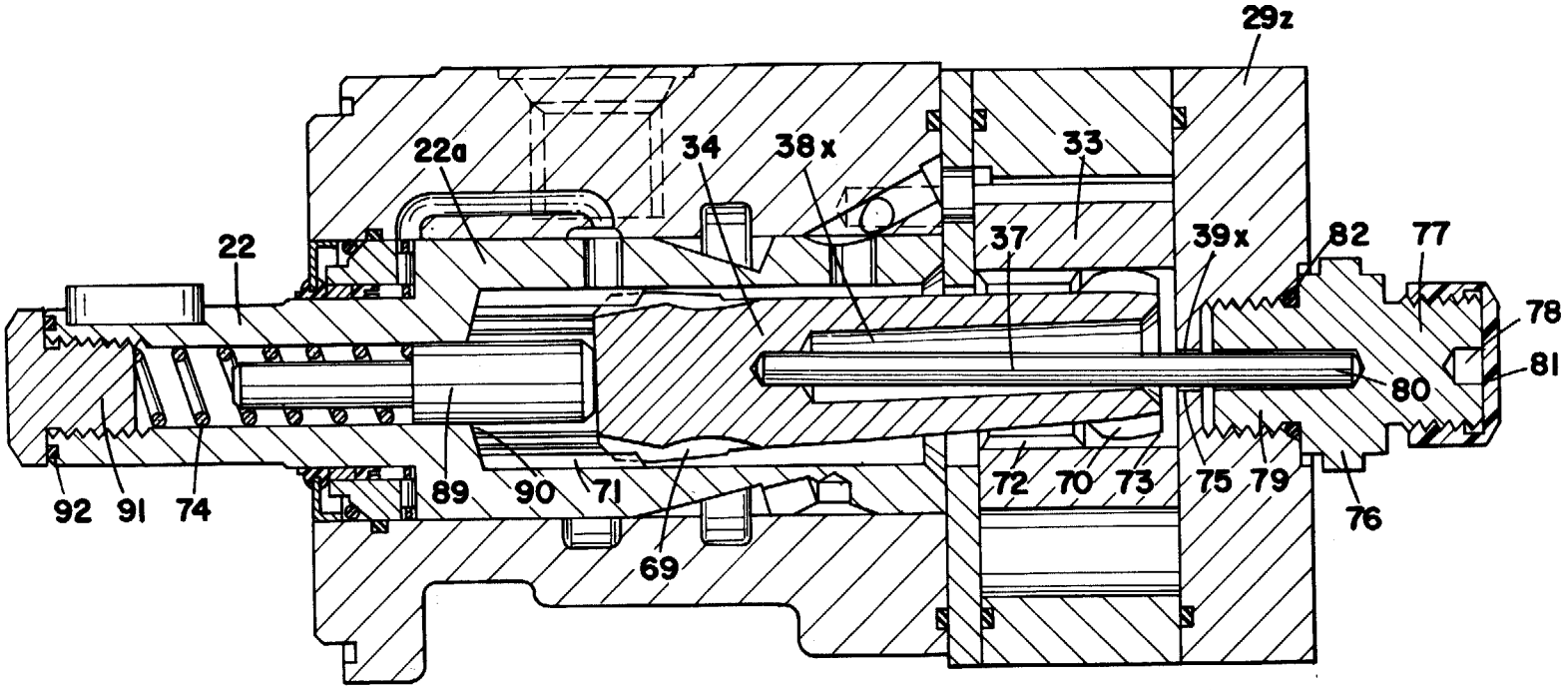

FIG. 25 is a central sectional view of the disengagable drive gerotor device of FIG. 24 with the drive in the disengaged position.

Figure 26:
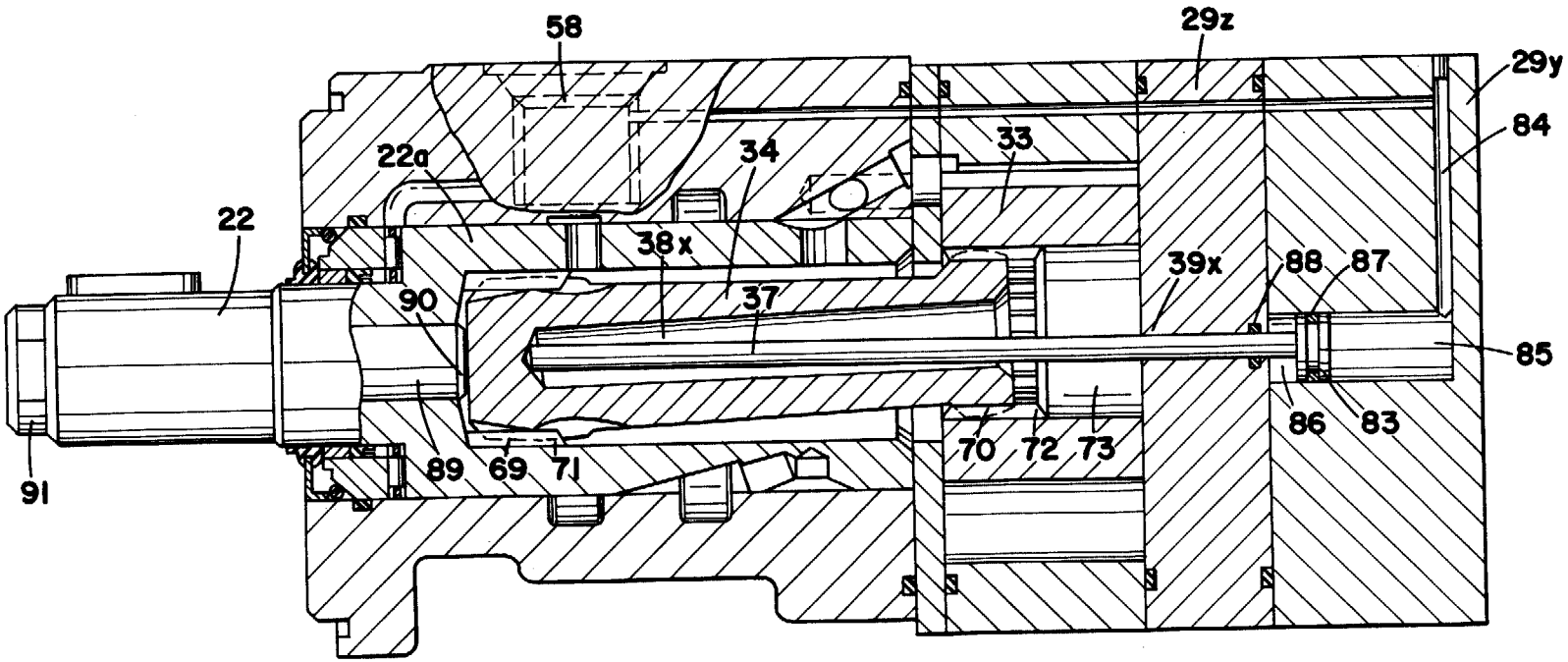

FIG. 26 is a central sectional view of an automatic hydraulicly actuated disengagable drive gerotor device with the drive in the engaged position.

Figure 27:
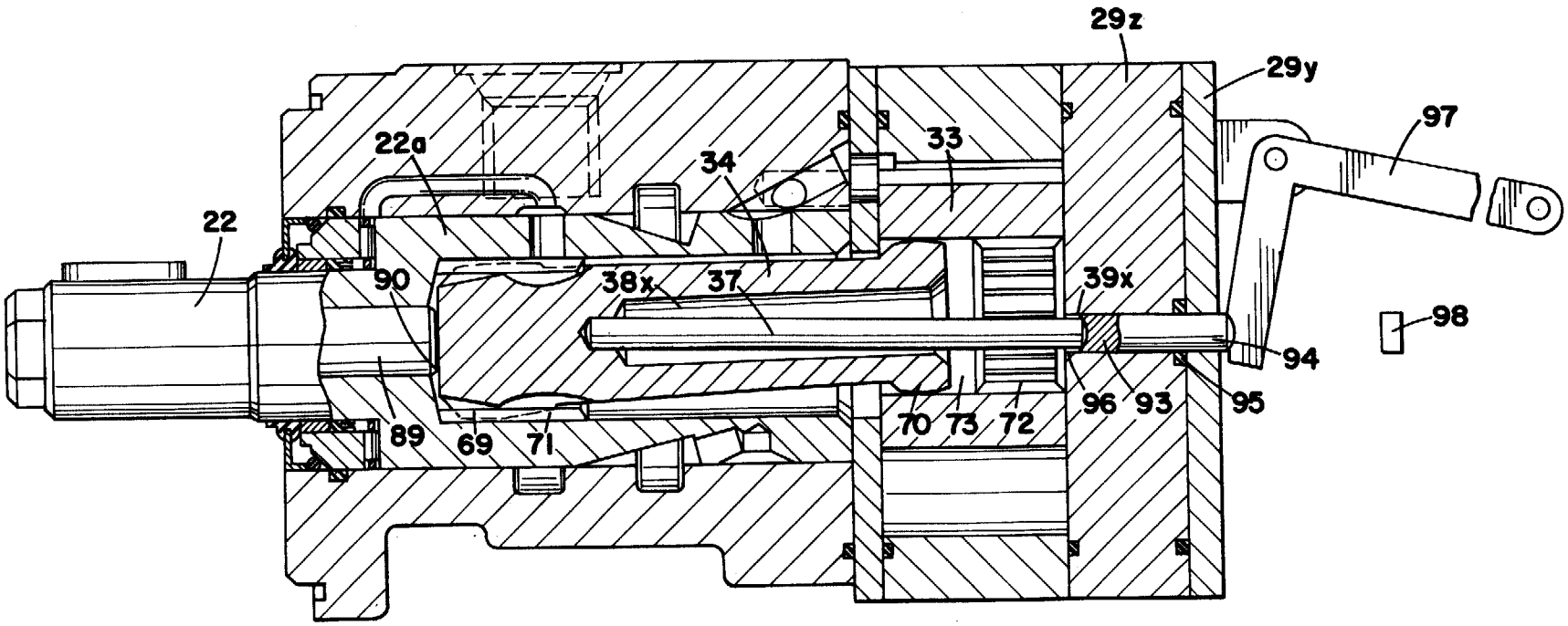

FIG. 27 is a central sectional view of an alternate disengagable drive gerotor device with the drive in the disengaged position.

Figure 2:
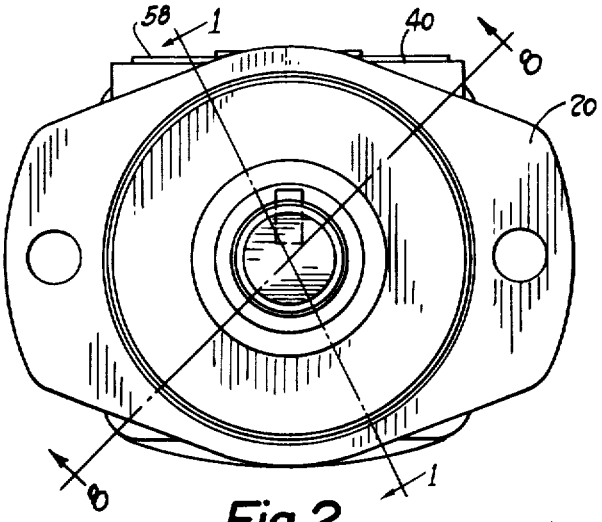
FIG. 2 is an end view of the same taken at the left-hand end of FIG. 1.

Referring now to FIGS. 1, 2 and 3 of the drawings, the rotary fluid pressure device of this invention comprises a housing 20 through which extends longitudinally a through opening 21. Into this opening fits a rotatable drive shaft 22 which has a hollow end **22*a* within the housing and a solid end portion 22*b* extending out the end of the housing. A manifold plate 23 extends crosswise of the housing with the seal between these two parts as shown at 24. Beyond the manifold is a wear plate 25 which is sealed by an annular seal 26 against the manifold and sealed by another annular seal 27 against the gerotor structure 28. The right-hand end of this combined structure as seen in FIG. 1 is closed by an end plate 29 which is sealed by an annular seal 30 against the gerotor structure. Suitable bolts 31 pass through the end plate 29, the gerotor structure 28, the wear plate 25 and the manifold 23 and are driven into threads in the housing 20** to hold all of these parts rigidly together.

To start with the gerotor structure best seen in FIG. 15, the stator 32 is fixed to the plate 28 and has a plurality of inwardly extending teeth **32*a* which match in sealing relation with the outwardly extending teeth 33***a* of the rotor 33 which rotates about its center R while the point R orbits around the stator center S. This action forms expanding cells numbered 5, 6 and 7 on FIG. 15 on one side of the line of eccentricity which runs through the points R and S, while forming contracting cells on the other side of the line of eccentricity numbered 1, 2 and 3 in FIG. 15. It should be understood that the device of this invention will be explained as a pump operation operated by power applied to the drive shaft 22. However, the device may be used as a motor by merely switching the fluid inlet and outlet ports later mentioned so as to drive the shaft 22 by the power developed in the gerotor.

Power is transmitted between the drive shaft 22 and the rotor 33 by means of a drive link or wobble stick 34. Teeth or parallel splines 34*a* on the left-hand end of the wobble stick as seen in FIG.1 mesh with coacting teeth or splines 35 provided at the inner end of the hollow portion of the drive shaft. At its opposite end, teeth 34*b* on the wobble stick mesh with coacting teeth or splines 36 on the rotor 33. The teeth 34*a* and 34*b* are so formed as to accommodate the orbiting action of the rotor as it passes around the stator. Portions 34*c* are cut away at certain parts of the wobble stick as shown in broken lines in FIG. 1 to enable the flow of the operating pressure fluid past the wobble stick as will later be described.

One of the novel constructions in the present fluid pressure device is the termination of the wobble stick at its right-hand end as seen in FIG. 1 in a position spaced from the end plate 29, and, instead of having the wobble stick impinge directly on the housing of the device, applicant uses a rigid separate pin 37 having one end 37*a* movably rotatable in an axial recess 38 in the adjacent end of the wobble stick, and the other end 37*b* is rotatably mounted on the axis of the drive shaft in a recess 39 in end plate 29. This novel drive prevents wear by eliminating the possibility of axial movement of the wobble stick relative to the drive shaft often caused by an uneven end position, caused by wear, when the wobble stick directly engages the housing. It also provides an inexpensive part, the pin 37, to change when changing gerotor stator 32.

The fluid inlet for this device comprises a fluid inlet opening 40 in the housing communicating through the housing to an annular passageway 41 which opens radially inwardly toward opening 21 in the hollow end 22*a* of the drive shaft. Six separate fluid inlet openings 42 are evenly spaced on the radially exterior face of the hollow end of the drive shaft as seen in FIGS. 1 and 3. Each of said inlets or openings comprises an inclined passageway as shown at 42 communicating at one end with the annular passageway 41 and inclined inwardly toward the hollow drive shaft at an angle of approximately 15°. Within the zone of the manifold the inclined slot communicates with a short bore 43 extending from the outer face of the housing shaft and inwardly for a depth less than the thickness of the shaft wall. To cooperate with each of these separate fluid inlet openings, the manifold 23 has seven evenly spaced through openings 44 closely outside the central through opening 21 in the hollow end of the shaft 22. These seven openings are seen in FIGS. 10 and 11, numbered 1 through 7, and FIG. 10 shows for each of these through openings, a communicating elongated axially extending slot 45 opening radially inwardly to the shaft-surrounding opening 21. Each of said through openings 44 aligns with a through opening 25*a* in the wear plate 25, and thence into communication with one of the openings 32*b* in the stator 32 as seen in FIG. 15 and so into one of the contracting or expanding cells numbered from 1 to 7 in FIG. 15.

Figure 16A:
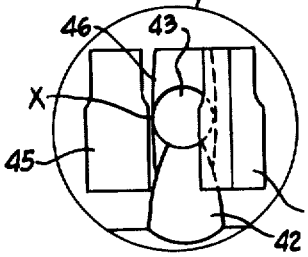

One of the novel features of this invention is that the drive shaft 22 has on its outer wall at the hollow end thereof, an axially extending, slightly barrel-shape hobbed shallow recess 46, best seen in FIGS. 7 and 16A extending equally in an axial direction on opposite sides of each of the short bores 43*a* and substantially the width centrally of the bore, and so positioned that, upon relative rotation between the shaft 22 and the manifold 23, as illustrated in FIG. 16A, the bore 43 or 43*a* approaches the hobbed recess 46 tangent to the widest portion of such hobbed recess. In this manner, the flow through each separate inlet occurs smoothly instead of abruptly.

Figure 10A:
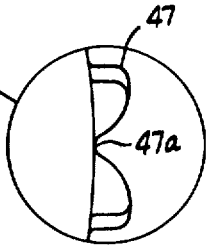

The introduction of inlet fluid entirely on one side of the line of eccentricity in the manifold would cause unbalancing in the manifold unless some opposite balancing effect were supplied. In the present invention this comprises the provision of a balancing pad 47 opening off of said central through opening 21 and directly opposite each of the slots 45 as seen in FIG. 10. Each of these balance pads is separated into two pads by an axially extending central partition 47*a* as seen in FIGS. 10 and 10A. Pressure is applied to each of these pads by a bore 43*a* in the hollow shaft wall evenly spaced between the openings 43 previously described. Each of the balance pad openings 47 in the manifold, as seen in FIG. 12, is substantially the same area as the diametrically opposite slots 45 also seen in FIG. 12. Thus, the manifold is substantially balanced at all times.

A novel seal arrangement is provided at the left-hand end of FIG. 1 where the solid portion 22*b* of the drive shaft exits from the housing 20. This is best seen in FIGS. 1 and 13. An annular seal 48 extends entirely around the solid shaft portion 22*b*. A generally L-shaped seal carrier 49 embraces this seal and has one leg 49*a* flat against the axial dimension of the shaft and having its other end 49*b* with a radial flat face 49*c* toward a radially extending flat shoulder 22*c* on the shaft. A rotatable annular needle thrust bearing 50 is provided between the flat radial surfaces 22*c* and 49*b* and tightly engaging both of such surfaces. The hollow shaft portion 21*a* which is in communication with the bore 21 is provided with a radially extending passageway 51 and communicates outwardly to the radial inner end of the thrust bearing 50. A bypass passageway 53 is provided between the outer end of the radial thrust bearing and the fluid outlet means 52. This bypass is indicated in FIGS. 1 and 13. It results from this construction that, when the device is operating in a rotative manner, the thrust bearing 50 acts as a small pump to pump liquid through the passageway 51 through the thrust bearing and past the seal carrier 49*b* and through the bypass 53 to the fluid outlet 52 and so on out of the machine. The seal carrier 49 is held by the fact 49*b*, against the thrust washer 50, in an exact position normal to the shaft 22 so that the other end of the seal carrier 49*a* is truly concentric with the shaft. Also, the thrust bearing race being an integral part of the seal carrier at 49*b*, causes the oil flow pumped by the bearing to cause a lower temperature of the seal, normally a hot point in the whole device. The dust cover 54 has a seal 55 against the shaft 22 and is held in position by the spiral wire spring 56.

The bypass 53 is best seen in FIGS. 1 and 8. The housing 20 is provided with a core to provide this bypass when this housing is cast.

The flow of the inlet fluid in the rotary fluid pressure device of this invention has been carefully described. The flow outwardly from the gerotor is through one of the openings 32*b*, through a matching passageway 25*a* into wear plate 25, then through a matching through opening 44 in the manifold 23 and then through an opening 51 through the wall of the hollow shaft portion 22*a* and then through the hollow opening 21*a* in the shaft and so into the annular opening 52 which surrounds the shaft opening and which is connected through the housing to the main fluid outlet opening 58.

The purpose of FIGS. 14 and 15 in a combined showing is to illustrate diagrammatically how passages 1, 2 and 3 may be connected by fluid lines 59 to similarly numbered passages 1, 2 and 3 in a gerotor structure while passages 5, 6 and 7 of the gerotor are connected by fluid passageways 60 to the through passages 5, 6 and 7 of the manifold.

The purposes of FIGS. 16, 16A and 17 is to illustrate diagrammatically how the slots 45 and the pad openings occur alternately around the manifold to one looking outwardly from the center of the manifold, and how the hobbed opening 46 approaches tangentially at X to the slots 45 or to the valve's pad openings of 47.

The view of FIG. 17 is from the hollow shaft wall 22*a* looking inwardly to the cooperating openings.

It should be mentioned that this invention requires exact positioning of the manifold 23 relative to the housing 20 and to this end dowel pins 61, seen in FIG. 1, enter some suitable openings 62 seen in FIGS. 10, 11 and 14 so as to very accurately position these two parts.

FIGS. 18 to 23 disclose an alternate form of this rotary fluid pressure invention. Substantially equivalent details will be covered in summary form; only the main points of difference between the two forms will be discussed in detail. Interchangeable parts continue to be numbered as in the first form. Different interchangeable parts are labeled Z.

The alternate form of this invention comprises a modified housing 20Z through which extends a through opening 21. Into this opening fits a rotatable drive shaft 22 which has a hollow end 22*a* within the housing and a solid end portion 22*b* extending out of one end of the housing 20Z. A wear plate 25 is sealed by an annular seal 26Z against the other end of the housing 20Z and sealed by another annular seal 27 against the gerotor structure 28. An end plate 29Z is sealed by an annular seal 30 against the gerotor structure 28. Suitable bolts 31 pass through the end plate 29Z, the gerotor structure 28 and the wear plate 25 and are attached by threads in the housing 20Z to hold all of these parts rigidly together. (There is no separate manifold plate 23.)

Power is transmitted between the drive shaft 22 and the gerotor structure 28 by means of a drive link or wobble stick 34. A rigid separate pin 37 prevents axial movement of the wobble stick 34 relative to the drive shaft.

The gerotor structure 28 has a stator 32 and a rotor 33 which rotates about its center R while the center R orbits around the stator center S forming expanding cells on one side of a line of eccentricity and contracting cells on the other side of a line of eccentricity. These cells communicate with fluid inlet means or fluid outlet means through openings 25A in the wear plate 25.

In a point of major difference with the earlier disclosed form, this alternate form has seven pairs of evenly spaced intersecting holes 66Z and 67Z in the other end of the modified housing 20Z forming the fluid passage means between the expanding and contracting gerotor cells and the fluid inlet bores 43 and fluid outlet holes 51, respectively. This is to be contrasted with the earlier disclosed form of this invention wherein the same ends were accomplished in a separate manifold 23 by seven evenly spaced through openings 44 connected to elongated axially extending slots 45.

Each hole 67Z is an angled through hole connecting the end face 69 of the housing with the inner through opening 21. Because hole 67Z intersects these surfaces at an angle, it presents elliptical openings. Hole 66Z is an axially extending hole from the end face 69 located slightly off center and below the end face opening of hole 67Z (See FIG. 22). Both holes 66Z and 67Z at their openings in the end face 69 open through the wear plate 25 into the gerotor cells (See FIG. 23). These holes intersect within the housing at port 68. This port greatly increased the volume of fluid that can pass through the passage system over that which could pass through either hole 66Z or hole 67Z alone. In particular, if the angled through hole 67Z was the only fluid passage conduit between the valving means and the gerotor cells there would be no advantage to the elliptical section it presents at its intersection with both. The limiting factor to fluid flow would be the circular diameter of hole 67Z. However, because it intersects with hole 66Z at port 68 and together they conduct fluid, the size of the relative main passageway is increased complementing the elliptical openings. Fluid can now flow freely between openings without the problems of cross-sectional constriction.

In another point of difference, bores 43 and holes 51 now terminate in shallow elliptical hollows instead of straight sections.

The fluid enters through a main fluid inlet opening 40 in the housing 20Z into a shaft surrounding circular annular passageway 41. The fluid travels from this passageway 41 through openings 42 into short bores 43. These openings 42 and short bores 43 are evenly spaced in pairs on the radially exterior face of the hollow end of the drive shaft. The fluid then travels through these short bores to enter hole 67Z and the expanding gerotor cells.

The fluid exits the contracting cells and hole 67Z through the six holes 51 through the wall of drive shaft's hollow end 22*a*. These holes 51 are evenly spaced on the radially exterior face of the hollow end of the drive shaft. The fluid travels through the hollow opening 21*a* in the shaft and so into the annular opening 52 which surrounds the shaft opening and which is connected through the housing 20Z to the main fluid outlet opening 58.

FIGS. 24–27 disclose a disengagable drive between the drive shaft and the gerotor structure.

In the operation of many hydraulic devices there are times when the hydraulic device is not actively required but when the machine to which the hydraulic device is attached is in motion. An example would be a jam clearing reversing motor in a thresher. The physical rotation of the hydraulic device during these periods of relative non-active operation produces wear on the hydraulic device through physical motion and thermal effects. In addition the fluid in the hydraulic system connected to the device is in motion creating further heat and the degradation of the fluid. Past solutions to these problems have been expensive, for example clutches between the hydraulic device and the machine or overdesigned devices, or of limited value, for example fluid by-pass valves. These past solutions are sufficiently unsatisfactory that most hydraulic device manufacturers and users accept limited life of the hydraulic devices when thus connected.

The invention herein includes a disengagable drive between the drive shaft and gerotor structure that solves the dilemma; the disengagable drive is reliable and inexpensive.

The disengagable drive is produced by the axial motion of the wobble stick from a position where it drivedly connects the drive shaft and gerotor structure to a position where it does not. The difference is a result of at least one end of the wobble stick being moved beyond the range of the teeth of the drive shaft and/or gerotor structure. See FIGS. 24–26.

In an engaged driving position the wobble stick 34 connects the drive shaft 22 to the rotor 33: the teeth 69, 70 of the wobble stick 34 engaging the teeth 71, 72 of the drive shaft 22 and rotor respectively. See FIGS. 24 and 26.

In the usual gerotor structure this is the condition of the wobble stick.

In the invention of this application, however, the wobble stick can be moved to a non-engaged position: the teeth 69, 70 of the wobble stick 34 not engaging either or both of the teeth 71, 72 of the drive shaft 22 and rotor 33 respectively. Contrast FIGS. 24 and 26 with FIGS. 25 and 27.

This selectable engagement is the result of there being an area 73 without teeth 71, 72 on one or both of the drive shaft 22 and rotor 33 into which the teeth 69, 70 of the wobble stick 34 may be selectively moved, this area 73 without teeth 71, 72 being at least slightly greater in length than the length of the respective wobble stick 34 teeth 69, 70. The area 73 without teeth 71, 72 can be located to vary the engaged-not engaged position of the wobble stick 34. Contrast FIG. 24 with FIG. 27. Normally the engaged position of the wobble stick 34 is at its innermost position in respect to the drive shaft 22.

In the embodiment of the invention disclosed the wobble stick 34 is selectively moved to engaged-not engaged positions in an axial direction by a rigid separate pin 37 and the pressure of a spring 74.

The rigid separate pin 37 extends between a recess 39X in an end plate 29Z and an axial recess 38X in the adjacent end of the wobble stick 34. The bottom of the recess 39X in the end plate 29Z can move axially of the device. This movement changes the effective length of the pin 37 to alter the engagement of the drive. The length of the rigid separate pin 37, the corresponding length of axial recess 38X in the wobble stick 34, and the diameter of the recesses should be chosen such that the rigid separate pin 37 can at all times easily retract into the bore of the recess upon the pressure applied by spring 74. In determining these dimensions consideration must be taken for the relative angular deviation of the rigid separate pin 37 (contrast the pins of FIGS. 19, 24 and 26), the diameter of the rigid separate pin 37 and the length of the actuation movement needed for the gerotor structure drive to move from enabling to non-enabling positions. The separate pin 37 should not bind on the lip 75 of the recess 39X or the lip of the recess 38X at any operable position of the separate pin 37.

In FIG. 24, the bottom of the recess 39X is defined by a double ended plug 76. One end 77 of the plug has a shallow recess 78. The other end 79 of the plug 76 has a deep recess 80. The difference in depth between the shallow 78 and deep 80 recess is substantially equal to the length of movement needed by the wobble stick 34 to move from an engaged to a not-engaged position. A removable cap 81 protects the plug's 76 threads. A seal 82 prevents hydraulic leakage.

The rigid separate pin 37 can be designed such that the axis of the rigid separate pin 37 is coextensive with the axis of the rotary fluid pressure device. This would enable the pin 37 to hold the wobble stick 34 in location without the pin 37 having any orbital motion. For this to occur the rigid separate pin 37 would be made long enough and the axial recess 38X in the wobble stick 37 deep enough such that the wobble stick end of rigid separate pin 37 intersects the wobble stick 34 substantially at the point of concentricity of the wobble stick 34 drive shaft 22 interconnection. With such a design the pin would only rotate when the rotary device is being operated and its motion from engaged to disengaged positions would be purely axial of itself. Under some circumstances such a purely axial motion of the rigid separate pin 37 would present easily comprehended advantages. On example would be the hydraulic actuation of FIG. 26. In this alternate embodiment a piston 83 is integral with the housing recess end of the separate rigid pin 37. A passage 84 connects the main motor input port 58 with the main cylinder 85 of the piston 83. Another passage (not shown) connects the other part 86 of the cylinder with an outlet. A seal 87 prevents fluid leakage by the piston 83. Another seal 88 prevents leakage between the main gerotor structure and the other part 86 of the cylinder. When fluid is valved by a remote valve (not shown)into the main motor input port 58 the main cylinder 85 is pressurized through passage 84. This causes the piston 83 to push the wobble stick 34 into an engaged position. This provides for an automatic engagement of the drive of the device whenever the device is called into usage. With modifications obvious to one skilled in the art this would be true whether the hydraulic device was a motor or a pump.

Returning to the discussion of this invention, and FIG. 24, at the other end of the wobble stick 34 a plunger 89 extends between the inner part 90 of the hollow end **22*a* of the drive shaft 22 and the wobble stick 34. A spring 74 acts to force the plunger 89, and wobble stick 34, axially of the device. The spring 74 bears on an end plug 91. A seal 92** prevents hydraulic leakage.

To move the wobble stick 34 from an engaged to a not-engaged position, or opposing, the double ended plug 76 is manually removed, physically reversed and then reinserted. This causes an axial motion of the separate pin 37 equal to the difference in the depth of the shallow 78 and deep 80 recess.

If the separate pin 37 was initially in the shallow recess 78 of the double ended plug 76 (as in FIG. 24), and wobble stick 34 at its innermost position in respect to the drive shaft 22, the reversing of the double ended plug would allow the spring force on the plunger 89 to move the wobble stick 34 to the alternate position (as in FIG. 25).

If the separate pin 37 was initially in the deep recess 80 of the double ended plug 76 (as in FIG. 25) the reverse would be true—one would move the wobble stick 34 against the spring force on the plunger 89 (to a position as in FIG. 24).

The engagement or non-engagement of the wobble stick 34 in these positions would depend on the location of the area 73 free of teeth 71, 72 (contrast FIG. 24 with FIG. 26).

In an alternate embodiment an actuation pin 93 replaces the double ended plug 76 (see FIG. 27). An end 94 of the actuation pin 93 extends out of the housing plate 29Y. A seal 95 prevents hydraulic leakage past the actuation pin 93.

The actuation pin 93 should be of a length at least equal to the distance of movement of the wobble stick necessary for alteration of status of the drive plus a distance for a seal. The actuation pin 93 should be of a diameter such that when the actuation pin 93 is furthest away from the drive shaft 22 the separate pin 37 does not contact the lip 96 of the bore of the actuation pin 93.

The actuation pin 93 allows for the remote alteration of the status of a drive of this invention having an orbital motion separate pin 37 (i.e. a device in which the longitudinal axis of the pin 37 meets the central longitudinal axis of the device at an angle other than plus or minus a few degrees. Please note that if the axis of separate pin 37 is that near the central longitudinal axis of the device, an actuation pin 93 is not necessary. In such a case, the end of the separate pin 37 itself can extend out of the housing in a manner similar to this actuation pin 93; any flexing of the pin 37 would be within acceptable limits.) A lever 97, electro-magnet (not shown) or other structure is easily connected to the end 94 of the actuation pin 93 to allow for remote alteration of the status of the drive of this invention.

The actuation pin 93 embodiment functions similarly to the unitary pin version: the end of the separate pin 37 at the housing is moved one way to engage the drive and another to disengage the drive.

Please note that the actuation pin 93 embodiment should have a physical stop 98 to prevent the actuation pin's becoming a projectile due to the internal pressure of the device.

Although the invention is designed for use as a motor, it is to be understood that it operates as a pump if the fluid inlet and outlet connections are reversed.

Our invention is sturdily constructed of few parts; the wear is carefully designed to be concentrated in four parts easily replaced in the field without major strip-down or even removing the device from allied machinery.

The first alternate form of the invention (FIGS. 1–17) has its advantages in that it is amenable to precision construction on readily available machinery. The second alternate form of the invention is stronger and made of fewer parts. All parts are field replaceable, and most others are interchangeable between forms.

Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and the scope of the invention as hereinafter claimed.

What is claimed is:

1. In a rotary fluid pressure device having a housing, a presure generating member, a drive shaft, a wobble stick drivingly connecting the pressure generating member with the drive shaft, the wobble stick connected to one of the pressure generating member or drive shaft by a teeth-teeth drive, the improvement of the one of the pressure generating member or drive shaft having teeth also having an area free of teeth, the teeth of the wobble stick being selectably movable into said area free of teeth and a position of not drivingly connecting the pressure member with the drive shaft, the wobble stick being located by a rigid separate wobble stick locating pin having opposite ends engaging between the pressure generating member end of the wobble stick and the housing, and in that the rigid separate pin has two selectable effective lengths, one length locating the teeth of the wobble stick in contact with the teeth of one of the pressure generating member or drive shaft, a position of engagement, and the other length locating the teeth of the wobble stick in the area of one of the pressure generating member or drive shaft free of teeth, a position of non-engagement.

2. The structure of claim 1 characterized by the rigid separate wobble stick locating pin engaging the housing in a recess and by the addition of a plug, said plug defining the bottom of the recess, the plug being selectably movable between two positions, one position providing a shallow recess and the other position providing a deeper recess, and said motion of said plug selecting the effective length of the rigid separate pin.

3. The structure of claim 2 characterized by the addition of a spring and said spring being between the drive shaft and wobble stick, said spring providing force for the wobble stick against the rigid separate pin in either of the pin's two effective lengths.

4. In a rotary fluid pressure device having a housing, a rotor having internal drive teeth, a drive shaft having drive teeth, a wobble stick with teeth at both ends drivingly connecting the rotor with the drive shaft and a rigid separate wobble stick locating pin having opposite ends engaging between an axial recess in the rotor end of the wobble stick and a recess in the housing, the improvement of a disengagable drive, said disengagable drive comprising at least one of the rotor or drive shaft having an area free of teeth, said area free of teeth being next to the driving connecting with the wobble stick, the teeth of the wobble stick driving the rotor and drive shaft having an area free of teeth being movable into said area free of teeth, a removable plug, said plug being double ended, one end of said plug having a shallow recess and the other end of said plug having a deep recess, said removable plug being selectively attachable to said housing, said recesses in said removable plug defining the recess in the housing, the selective attachment of said removable plug causing the rigid separate wobble stick locating pin to locate the teeth of the wobble stick driving the rotor and drive shaft having an area free of teeth in respect to said area free of teeth to alter the status of the drive of the device.

5. The structure of claim 4 characterized in that said axial recess in the rotor end of the wobble stick extends substantially to the point of concentricity of the wobble stick drive shaft interconnection.

6. In a rotary fluid pressure device having a housing, a pressure generating member, a drive shaft, a wobble stick drivingly connecting the pressure generating member with the drive shaft in teeth-teeth type connections and a rigid separate wobble stick locating pin having opposite ends engaging between the pressure generating member end of the wobble stick and a recess in the housing, the improvement of a disengagable drive, said disengagable drive comprising at least one of the pressure generating member and said drive shaft having an area free of teeth, the teeth of the wobble stick driving the pressure generating member and drive shaft having an area free of teeth being movable into said area free of teeth, the recess in the housing having a depth and said depth of said recess being selectably adjustable between shallow and deep, said selectable adjustment of the depth of the recess causing the rigid separate wobble stick locating pin to locate the teeth of the wobble stick driving the pressure generating member and drive shaft having an area free of teeth in respect to said area free of teeth to alter the status of the drive of the device.

7. The structure of claim 6 characterized by the addition of an actuation pin, said actuation pin having an end, said end of said actuation pin defining the bottom of the recess in the housing and means to selectably move said actuation pin, the movement of said actuation pin adjusting the depth of the recess between shallow and deep.

8. The structure of claim 7 characterized in that said actuation pin has a second end and said second end of said actuation pin extending out of the housing.

9. The structure of claim 6 characterized in that the recess in the housing is on the centerline of the drive shaft of the rotary fluid pressure device and in that central axis of the rigid separate wobble stick locating pin differs from the centerline of the drive shaft of the rotary fluid pressure device.

10. The structure of claim 9 characterized in that the recess in the housing is on the centerline of the drive shaft of the rotary fluid pressure device and in that central axis of the rigid separate wobble stick locating pin is substantially co-extensive with the centerline of the drive shaft of the rotary fluid pressure device.

11. The structure of claim 5 characterized in that the rigid separate wobble stick locating pin engages the wobble stick in an axial recess and in that the axial recess in the wobble stick extends to the point of concentricity of the wobble stick drive shaft interconnection, the central axis of the rigid separate wobble stick locating pin being co-extensive with the central axis of the rotary fluid pressure device.

12. The structure of claim 11 characterized by the addition of a piston, said piston defining the bottom of the recess in the housing and means to selectably actuate said piston, the movement of said piston adjusting the depth of the recess between shallow and deep.

* * * * *